US012185799B2

(12) United States Patent
Nakatsuka

(10) Patent No.: US 12,185,799 B2
(45) Date of Patent: Jan. 7, 2025

(54) BAND PIECE, BAND AND TIMEPIECE

(71) Applicant: CASIO COMPUTER CO., LTD., Tokyo (JP)

(72) Inventor: Yoshiki Nakatsuka, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 584 days.

(21) Appl. No.: 17/412,494

(22) Filed: Aug. 26, 2021

(65) Prior Publication Data

US 2022/0061474 A1 Mar. 3, 2022

(30) Foreign Application Priority Data

Aug. 27, 2020 (JP) ..... 2020-143333

(51) Int. Cl.
*A44C 5/10* (2006.01)
*A44C 5/00* (2006.01)

(52) U.S. Cl.
CPC ..... *A44C 5/107* (2013.01); *A44C 5/0061* (2013.01)

(58) Field of Classification Search
CPC ..... A44C 5/107; A44C 5/0061; A44C 5/10; A44C 5/02; F16G 15/12
See application file for complete search history.

(56) References Cited

U.S. PATENT DOCUMENTS

| | | | | |
|---|---|---|---|---|
| 10,342,303 | B2 * | 7/2019 | Yamakawa | A44C 5/107 |
| 2013/0145795 | A1 * | 6/2013 | Asami | A44C 5/02 403/119 |
| 2018/0168293 | A1 * | 6/2018 | Leiggener | A44C 5/107 |

FOREIGN PATENT DOCUMENTS

| | | | | |
|---|---|---|---|---|
| CH | 698936 | B1 * | 12/2009 | A44C 5/107 |
| DE | 2133008 | A1 * | 1/1973 | A44C 5/107 |
| EP | 576998 | A1 * | 1/1994 | A44C 5/107 |
| JP | S60-14716 | U | 1/1985 | |
| JP | H01-143918 | U | 10/1989 | |
| JP | H03-244404 | A | 10/1991 | |
| JP | 3085621 | U | 5/2002 | |
| JP | 3148398 | U | 2/2009 | |
| JP | 2014-087455 | A | 5/2014 | |
| JP | 2015-029806 | A | 2/2015 | |
| JP | 6044267 | B2 | 12/2016 | |

OTHER PUBLICATIONS

Notice of Reasons for Refusal dated Aug. 8, 2022 received in Japanese Patent Application No. JP 2020-143333.

* cited by examiner

*Primary Examiner* — Jack W Lavinder
(74) *Attorney, Agent, or Firm* — SCULLY SCOTT MURPHY & PRESSER, PC

(57) ABSTRACT

A band piece including a first piece which has a connection recess recessed in a piece connection direction and a connection projection projecting in the piece connection direction, a second piece which is arranged on one surface of the first piece while corresponding to the connection projection of the first piece, and an engaging portion which engages the first piece with the second piece.

20 Claims, 8 Drawing Sheets

BAND PIECE, BAND AND TIMEPIECE

CROSS-REFERENCE TO RELATED APPLICATION

This application is based upon and claims the benefit of priority from the prior Japanese Patent Application No. 2020-143333, filed Aug. 27, 2020, the entire contents of which are incorporated herein by reference.

BACKGROUND

1. Technical Field

The technical field relates to a band piece that is used for wristwatches, bracelets, handbags, and the like, a band formed by the band piece being plurally connected, and a timepiece having the band.

2. Description of the Related Art

For example, a wristwatch band is known in which each band piece includes a pair of outer pieces made of synthetic resin, an inner piece which is also made of synthetic resin and arranged between the pair of outer pieces, and side pieces which are made of metal and attached to the outside surfaces of the outer pieces, and is formed by these pieces being connected in a substantially Y-shape by a pin component, as described in Japanese Utility Model Registration No. 3148398.

SUMMARY

One embodiment is a band piece comprising: a first piece which has a connection recess recessed in a piece connection direction and a connection projection projecting in the piece connection direction; a second piece which is arranged on one surface of the first piece while corresponding to the connection projection of the first piece, and an engaging portion which engages the first piece with the second piece.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

An embodiment of a wristwatch will hereinafter be described with reference to FIG. 1 to FIG. 8.

Figure 1:
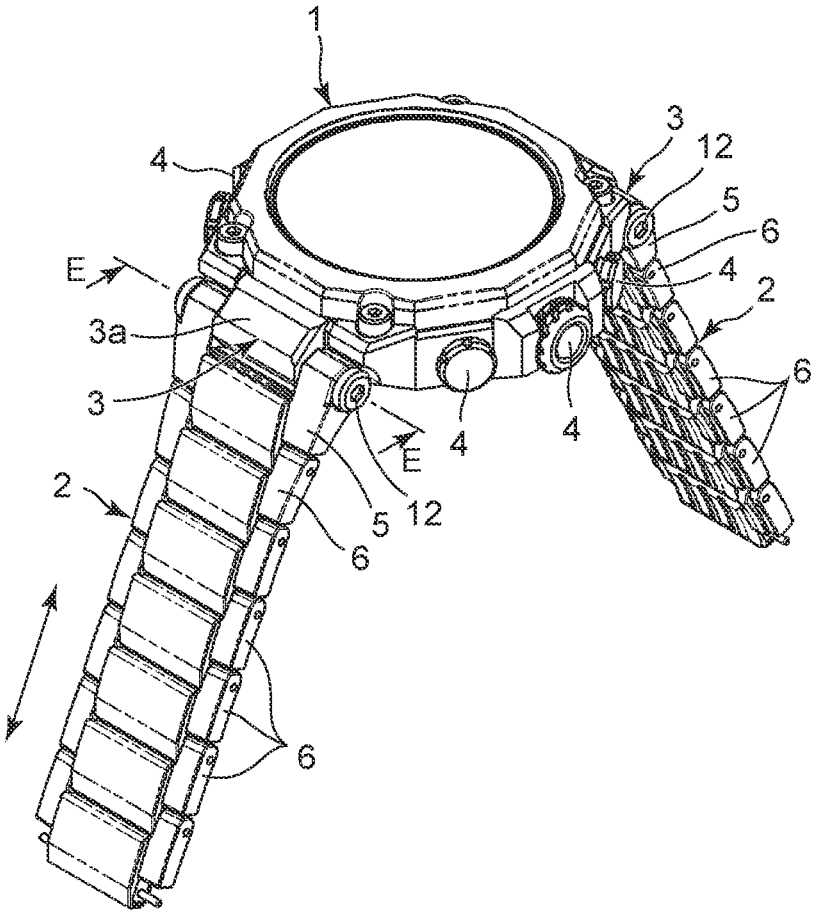
FIG. 1 is an enlarged perspective view showing a first embodiment of a wristwatch.

This wristwatch includes a wristwatch case 1, as shown in FIG. 1. On the twelve o'clock side and six o'clock side of the wristwatch case 1, band attachment sections 3 to which watch bands 2 are attached are provided. Also, on the two o'clock side, three o'clock side, four o'clock side, eight o'clock side, and ten o'clock side of the wristwatch case 1, switch devices 4 are provided.

Figure 2:
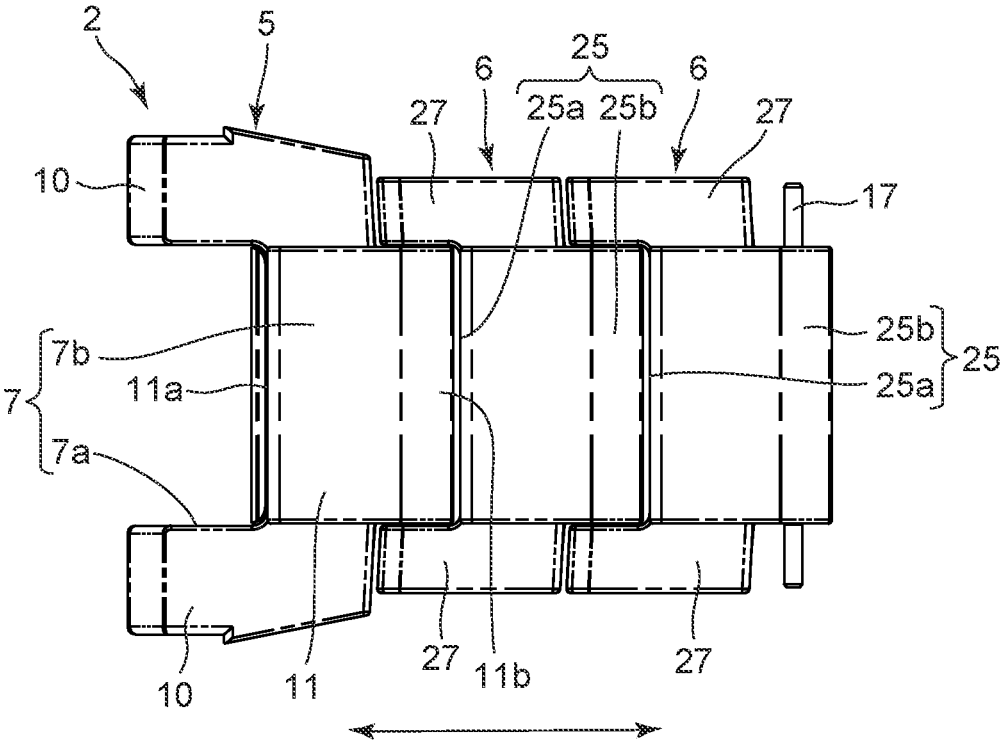
FIG. 2 is an enlarged front view showing a portion of a wristwatch band of the wristwatch shown in FIG. 1.

Each watch band 2 includes a first band piece 5 which is attached to the corresponding band attachment section 3 of the wristwatch case 1, and a plurality of second band pieces 6 which is sequentially connected to one another and attached to the first band piece 5, as shown in FIG. 1 and FIG. 2. The first band piece 5 includes a first piece 7 made of a metal such as stainless steel or titanium alloy, and a second piece 8 made of a synthetic resin such as a resin acquired by carbon fiber or glass fiber being mixed into polyamide resin, or urethane resin, as shown in FIG. 2 to FIG. 5.

The first piece 7 includes a first connection recess section 7*a* which is provided on one side (left side in FIG. 3A) in the piece connection directions (indicated by vertical arrows in FIG. 1 and horizontal arrows in FIG. 2) and in which the band attachment section 3 is arranged, and a first connection projection section 7*b* which is provided on the other side (right side in FIG. 3A) in the piece connection directions. The second piece 8 is structured to be arranged on the under surface of the first connection projection section 7*b* of the first piece 7.

The first piece 7 has a pair of first arm sections 10 which forms side portions of the first connection recess section 7*a* in a width direction perpendicular to a piece connection direction, and a projection main body 11 which forms the first connection projection section 7*b*, as shown in FIG. 3A, FIG. 3B, FIG. 3C, and FIG. 5. The projection main body 11, which is provided between the pair of first arm sections 10, is formed such that its one end section 11*a* on the one side in the piece connection direction is located corresponding to a substantially middle portion of each first arm section 10 in the piece connection direction, and its other end section 11*b* on the other side in the piece connection direction projects further outward than the ends (right ends in FIG. 3A) of the pair of first arm sections 10 on this side in the piece connection direction.

In addition, the first piece 7 is formed such that the projection length of each first arm section 10 in the piece connection direction from its portion corresponding to the one end section 11*a* of the projection main body 11 in the piece connection direction is substantially equal to that of the other end section 11*b* of the projection main body 11 in the piece connection direction from its portion corresponding to the above-described ends (right ends in FIG. 3A) of the pair of first arm sections 10 in the piece connection direction, as shown in FIG. 3A to FIG. 5. That is, the first piece 7 is formed such that the length of the first connection recess section 7*a* in the piece connection direction is substantially equal to the projection length of the other end section 11*b* of the projection main body 11 in the piece connection direction.

Each first arm section 10 is formed in a substantially square bar shape such that its end portion on the one side (left side in FIG. 3A) in the piece connection direction, or more specifically, its end portion on the opposite side of the projection main body 11 has a substantially semicircular shape. Also, these first arm sections 10 are formed such that the length (space) between their opposing surfaces in the width direction perpendicular to the piece connection direction is substantially equal to the length of the band attachment section 3 in the width direction perpendicular to the projection direction, as shown in FIG. 1.

Figure 8:
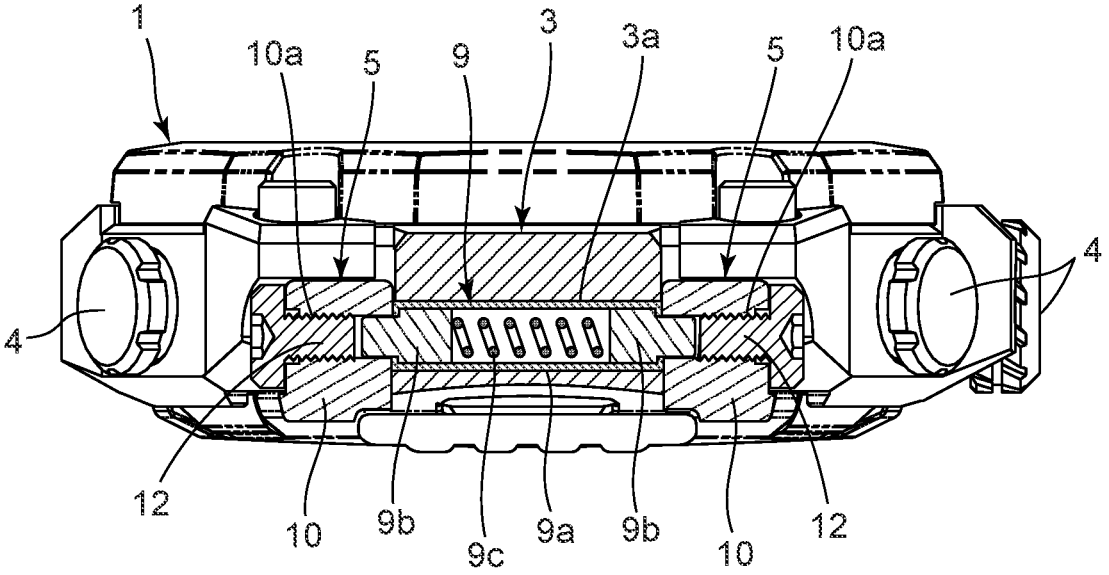
FIG. 8 is an enlarged side view showing the wristwatch taken along the E-E arrow view in FIG. 1.

In the opposing surfaces of the pair of first arm sections 10 in the width direction perpendicular to the piece connection direction, screw holes 10*a* into which ornament screws 12 are screwed are coaxially provided, as shown in FIG. 1 to FIG. 5. Each of these ornament screws 12 is formed such that its axial length is about half the length of each screw hole 10*a* of the first arm sections 10, as shown in FIG. 8. Also, the screw holes 10*a* of the pair of the first arm sections 10 are structured such that end portions of a connection member 9 provided in the band attachment section 3 of the wristwatch case 1 are inserted thereinto.

The connection member 9 includes a connection pipe 9*a* which is inserted into an attachment hole 3*a* of the band attachment section 3, two connection pieces 9*b* which are arranged in the connection pipe 9*a*, and a spring member 9*c* which is arranged in the connection pipe 9*a* and retractably pushes the two connection pieces 9*b* outward from the ends of the connection pipe 9*a*, as shown in FIG. 8.

Also, the connection member 9 is structured such that, when the connection pipe 9*a* is attached to the attachment hole 3*a* of the band attachment section 3, the two connection pieces 9*b* protrude from the sides of the band attachment section 3, and are inserted into the screw holes 10*a* of the pair of first arm sections 10, whereby the first band piece 5 is attached to the band attachment section 3 of the wristwatch case 1, as shown in FIG. 8.

That is, the first piece 7 is structured such that, when the band attachment section 3 provided on the wristwatch case 1 is arranged in the first connection recess section 7*a*, the two connection pieces 9*b* of the connection member 9 attached to the attachment hole 3*a* of the band attachment section 3 are inserted into the screw holes 10*a* of the pair of first arm sections 10, whereby the first piece 7 is attached to the band attachment section 3 of the wristwatch case 1, as shown in FIG. 8.

Also, this first piece 7 is structured such that the ornament screws 12 are screwed into the screw holes 10*a* of the pair of first arm sections 10 from the sides thereof in the width direction perpendicular to the piece connection direction with the first piece 7 being attached to the band attachment section 3 of the wristwatch case 1, whereby the screw holes 10*a* of the pair of first arm sections 10 are covered, as shown in FIG. 1 and FIG. 8.

The projection main body 11 has a substantially box shape that is thin and open downward, as shown in FIG. 3A to FIG. 5. This projection main body 11 is formed such that its length in the width direction perpendicular to the piece connection direction is substantially equal to the length (space) between the pair of first arm sections 10 in the width direction perpendicular to the piece connection direction. Also, this projection main body 11 is formed such that its upper surface is slightly higher than the upper surfaces of the pair of first arm sections 10.

Figure 3A:
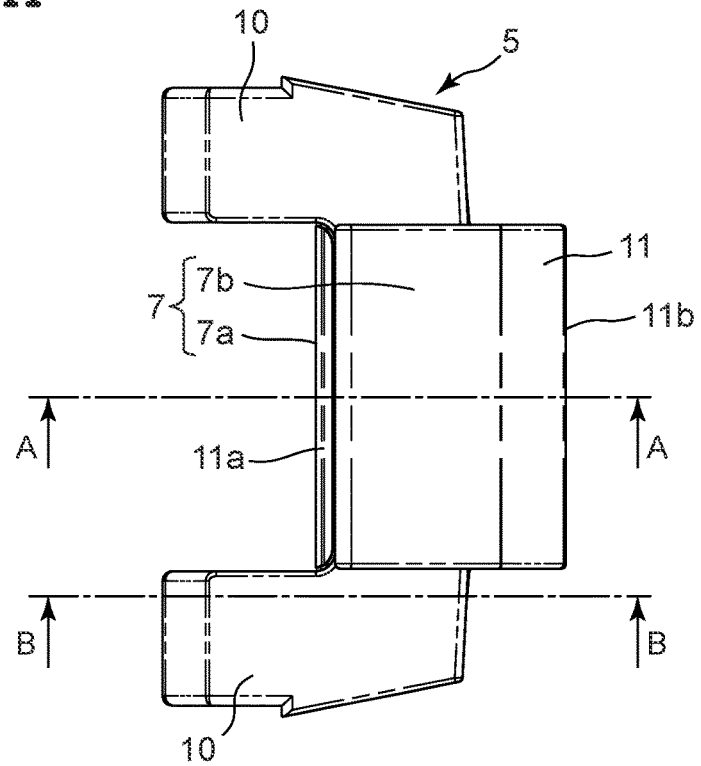
FIG. 3A is an enlarged front view of a first band piece of the wristwatch band shown in FIG. 2.
Figure 3B:
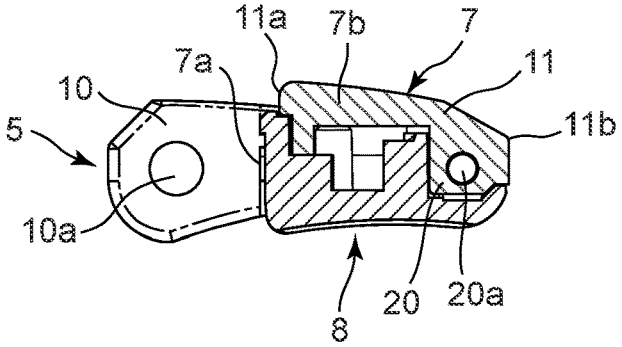
FIG. 3B is an enlarged cross-sectional view showing the first band piece taken along the A-A arrow view in FIG. 3A.
Figure 3C:
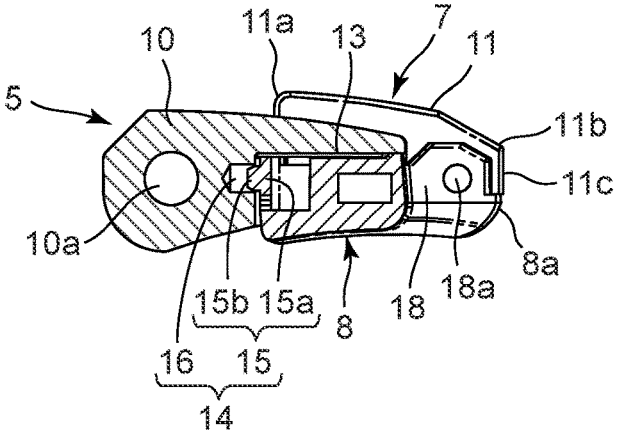
FIG. 3C is an enlarged cross-sectional view showing the first band piece taken along the B-B arrow view in FIG. 3A.
Figure 4:
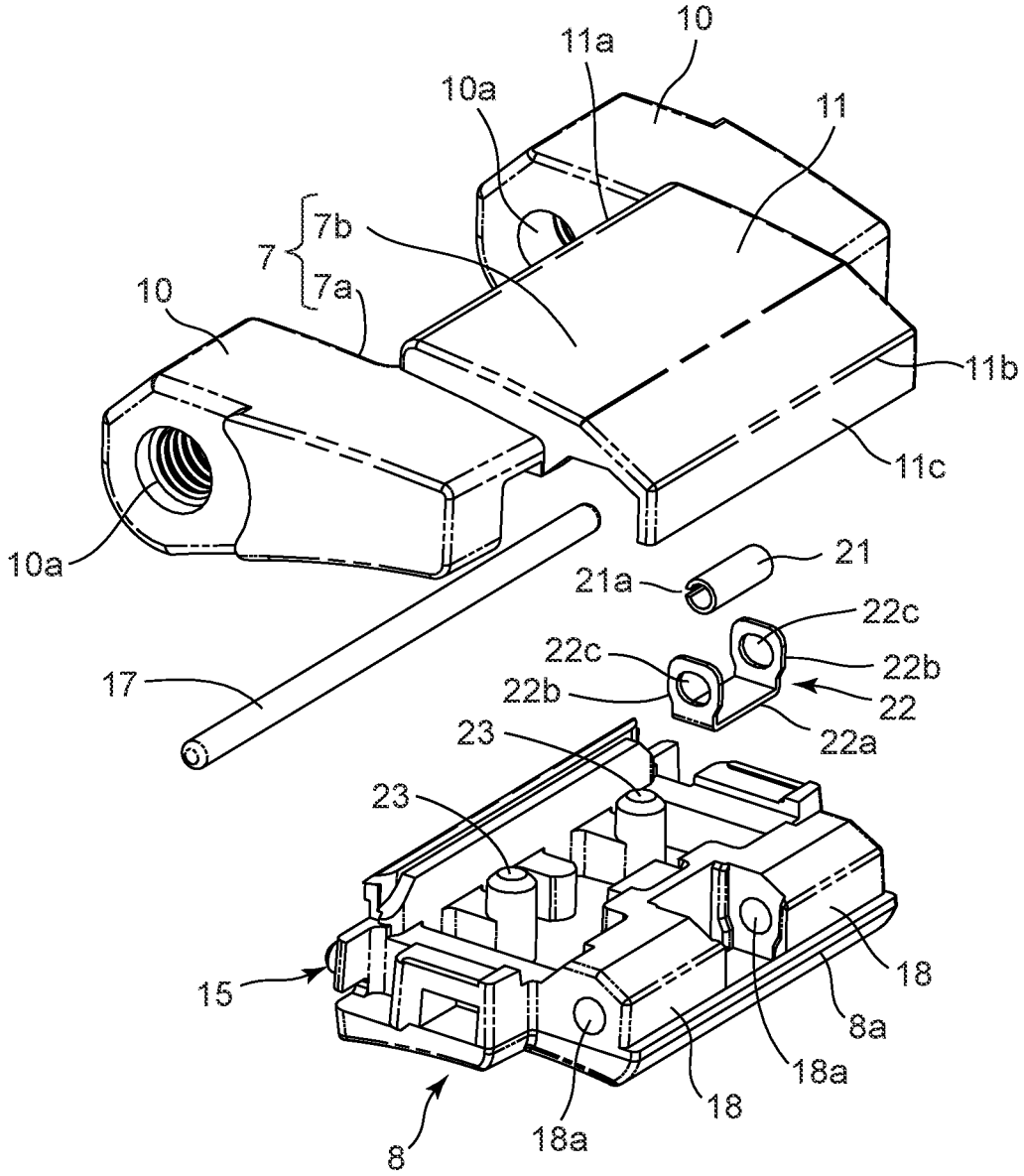
FIG. 4 is an enlarged perspective view showing the first band piece of FIG. 3A in a disassembled state.
Figure 5:
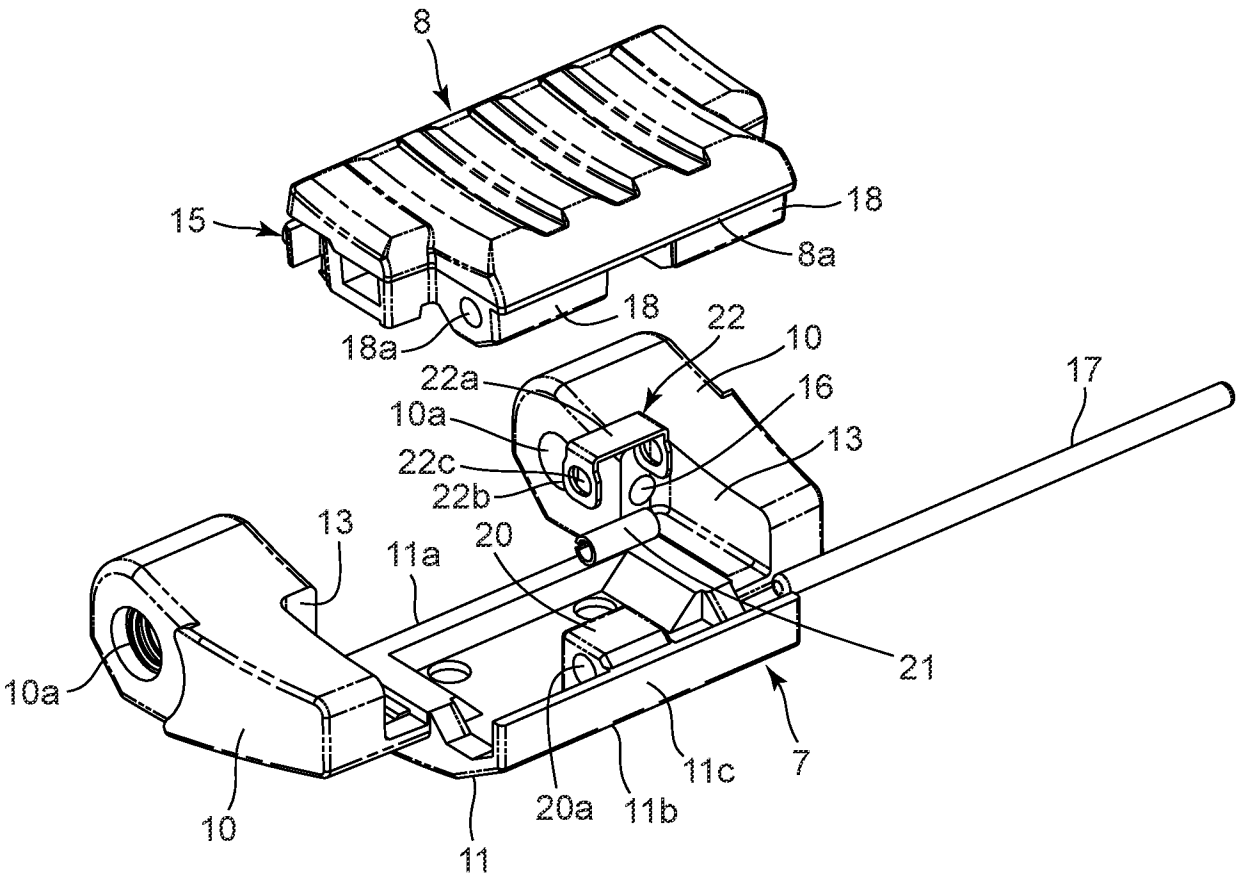
FIG. 5 is an enlarged perspective view of the first band piece of FIG. 4 when inverted.

On an edge of the projection main body 11, or more specifically, on the other end section 11*b* of the projection main body 11, a protection cover 11*c* is provided projecting downward, as shown in FIG. 3A to FIG. 5. Also, in the first piece 7, cutout recess sections 13 are provided in the opposing surfaces of the pair of first arm sections 10 which correspond to the sides of the projection main body 11 in the width direction perpendicular to the piece connection direction, as shown in FIG. 5.

Figure 6:
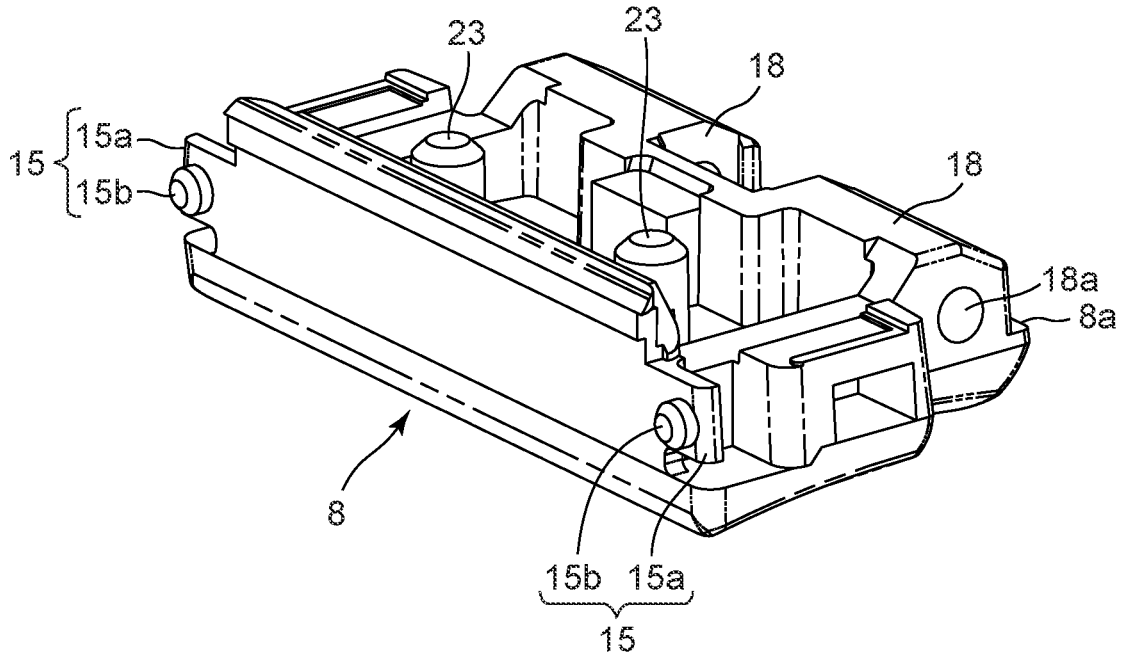
FIG. 6 is an enlarged perspective view showing a second piece of the first band piece of FIG. 4 when viewed from the left side.

On the other hand, the second piece 8 is formed in a substantially square box shape having recesses and projections, as shown in FIG. 3 A to FIG. 6. This second piece 8 is structured to be arranged on the undersurface of the projection main body 11 of the first piece 7. More specifically, this second piece 8 is arranged on the undersurface of the first piece 7 from the one end section 11*a* of the projection main body 11, which is the inner end of the first connection recess section 7*a* of the first piece on the one side (left side in FIG. 3A) in the piece connection direction, to the other end section 11*b* of the projection main body 11, which is the outer end of the first connection projection section 7*b* on the other side (right side in FIG. 3A) in the piece connection direction.

Also, this second piece 8 is structured to be arranged on the undersurface of the projection main body 11 of the first piece 7 such that its side portions in the width direction perpendicular to the piece connection direction are arranged in the cutout recess sections 13 provided in the opposing surfaces of the pair of first arm sections 10, and its undersurface portion downwardly projects slightly lower than the undersurfaces of the pair of the first arm sections 10, as shown in FIG. 3A to FIG. 6.

Moreover, this second piece 8 is structured such that its one end (left end in FIG. 3C) in the piece connection direction is held in the first piece 7 by engagement by an engaging and holding section 14 that is a section for engagement, as shown in FIG. 3A to FIG. 6. The engaging and holding section 14 includes resilient engaging sections 15 which are resiliently deformable and provided on end portions of the second piece 8 corresponding to the first connection recess section 7*a* of the first piece 7, or more specifically, side portions of the one end of the second piece 8 in the piece connection direction, and catching holes 16 which are provided in surfaces of the cutout recess sections 13 of the first piece 7 opposing the resilient engaging sections 15 and with which the resilient engaging sections 15 are engaged.

The resilient engaging sections 15 include resilient supporting sections 15*a* which have a flat spring shape and are provided to be flexurally deformable on the side portions of the one end (left end in FIG. 6) of the second piece 8 in the piece connection direction, and engaging projections 15*b* which are provided on the resilient supporting sections 15*a* and engage with the catching holes 16 of the first piece 7, as shown in FIG. 3A to FIG. 6.

These resilient supporting sections 15*a* are provided projecting in directions perpendicular to the piece connection direction, on the side portions of the one end (left end in FIG. 3A) of the second piece 8 on the first connection recess section 7*a* side, as shown in FIG. 3A, FIG. 3B, FIG. 3C, and FIG. 6. That is, the resilient supporting sections 15*a* are structured to be flexurally deformed in the piece connection direction, on the side portions of the one end of the second piece 8. The engaging projections 15*b* have a substantially columnar shape and are structured to be fitted into the catching holes 16 by the resilient force of the resilient supporting sections 15*a*.

The catching holes 16 are provided in the inner surfaces of the cutout recess sections 13 of the first piece 7 opposing the resilient supporting sections 15*a* such that their central axes are oriented in the piece connection direction. These catching holes 16 are formed such that their diameters are greater than the outer diameters of the engaging projections 15*b*. That is, the catching holes 16 are structured to catch the engaging projections 15*b* inserted thereinto by the resilient force of the resilient supporting sections 15*a*.

On the other hand, on the other end (right end in FIG. 3A) of the second piece 8 in the piece connection direction, a contact holding section 8*a* is provided which is structured to be held by the protection cover 11*c* provided on the edge of the projection main body 11, that is, the other end section 11*b* of the projection main body 11 in the piece connection direction, as shown in FIG. 3A to FIG. 6. As a result, the second piece 8 is structured such that, when the contact holding section 8*a* provided on the other end in the piece connection direction is held by the protection cover 11*c* of the projection main body 11, this second piece 8 is provisionally fixed to the first piece 7 while being protected by the protection cover 11*c*.

Also, the second piece 8 is structured such that, when this second piece 8 is to be arranged on the undersurface of the projection main body 11 of the first piece 7, the engaging projections 15*b* of the resilient engaging sections 15 provided on the side portions of the one end of the second piece 8 in the piece connection direction are caught in the catching holes 16 in the inner surfaces of the cutout recess sections 13 of the first piece 7 opposing the resilient supporting sections 15*a* by the resilient force of the resilient supporting sections 15*a* with the other end of the second piece 8 in the piece connection direction being held by the protection cover 11*c* of the projection main body 11, whereby the second piece 8 is attached to the first piece 7.

More specifically, the second piece 8 is structured such that, when this second piece 8 is to be arranged on the undersurface of the projection main body 11 of the first piece 7, the engaging projections 15*b* of the resilient engaging sections 15 come in contact with the inner surfaces of the cutout recess sections 13 of the first piece 7 opposing the resilient supporting sections 15*a*, the resilient supporting sections 15*a* are flexurally deformed, and the engaging projections 15*b* are inserted into the catching holes 16 of the cutout recess sections 13 and caught therein by the resilient recovery force of the flexurally deformed resilient supporting sections 15*a* at the timing at which the engaging projections 15*b* are positioned corresponding to the catching holes 16 of the cutout recess sections 13, whereby the second piece 8 is attached to the first piece 7, as shown in FIG. 3A to FIG. 6.

The first band piece 5 is structured such that the first connection projection section 7*b* of the first piece 7 and the second piece 8 are connected to each other by a corresponding pin component 17, as shown in FIG. 3A to FIG. 5. More specifically, on the other end of the second piece 8 in the piece connection direction, a pair of connection projections 18 is provided in the direction perpendicular to the piece connection direction. In this pair of connection projections 18, first pin insertion holes 18*a* into which the pin component 17 is inserted are coaxially provided in the direction perpendicular to the piece connection direction.

On the other end section 11*b* of the projection main body 11 of the first piece 7 in the piece connection direction, a fixing projection 20 which is arranged between the pair of connection projections 18 of the second piece 8 is provided projecting downward, as shown in FIG. 3A to FIG. 5. In this fixing projection 20, a pin attachment hole 20*a* into which the pin component 17 is inserted is provided in the direction perpendicular to the piece connection direction.

As a result, the first band piece 5 is structured such that, when the fixing projection 20 of the first piece 7 is arranged between the pair of connection projections 18 of the second piece 8 by the second piece 8 being arranged on the undersurface of the projection main body 11 of the first piece 7, the first pin insertion holes 18*a* of the pair of connection projections 18 and the pin attachment hole 20*a* of the fixing projection 20 coaxially correspond to one another in the direction perpendicular to the piece connection direction, as shown in FIG. 3A to FIG. 5.

The pin component 17 is formed such that its outer diameter is substantially equal to the diameter of each first pin insertion hole 18*a* of the pair of connection projections 18, and its axial length is substantially equal to the length between the outer side surfaces of the pair of first arm sections 10 of the first piece 7 in the width direction perpendicular to the piece connection direction, as shown in FIG. 3A to FIG. 5.

That is, the pin component 17 is structured such that its end portions protrude from the sides of the projection main body 11 in the width direction perpendicular to the piece connection direction when this pin component 17 is inserted into the first pin insertion holes 18*a* of the pair of connection projections 18 and the pin attachment hole 20*a* of the fixing projection 20 with the fixing projection 20 of the first piece 7 being arranged between the pair of connection projections 18 of the second piece 8, as shown in FIG. 3A to FIG. 5.

The pin attachment hole 20*a* provided in the fixing projection 20 of the first piece 7 is formed such that its diameter is greater than the diameter of each first pin insertion hole 18*a* of the pair of the connection projection 18, or in other words, the outer diameter of the pin component 17. In this pin attachment hole 20*a*, a fixing pipe 21 that is a fixing member such as a C-ring is provided, as shown in FIG. 3A to FIG. 5.

This fixing pipe 21 has a slit 21*a* formed on its outer circumferential portion in the axial direction and is structured to be deformed and expanded in the radial direction. Also, this fixing pipe 21 is formed such that its inner diameter is slightly shorter than the outer diameter of the pin component 17, and its outer diameter is substantially equal to the diameter of the pin attachment hole 20*a*. In addition, this fixing pipe 21 is formed such that its axial length is substantially equal to or slightly shorter than the axial length of the pin attachment hole 20*a* of the fixing projection 20.

As a result, the fixing pipe 21 herein is structured such that, when the pin component 17 is inserted into the fixing pipe 21 after the fixing pipe 21 is inserted into the pin attachment hole 20*a* of the fixing projection 20, the fixing pipe 21 is expanded in the radial direction by the pin component 17, and the outer circumferential surface of the fixing pipe 21 is pressed against the inner circumferential surface of the pin attachment hole 20*a* of the fixing projection 20, whereby the pin component 17 is fixed in the pin attachment hole 20*a*, as shown in FIG. 4 and FIG. 5.

Also, to the fixing projection 20, a stopper member 22 for preventing the fixing pipe 21 from slipping out from the pin attachment hole 20*a* is attached, as shown in FIG. 4 and FIG. 5. This stopper member 22 is formed by side portions of a metal plate being bent, and is structured such that a placement piece 22*a* in the middle of the metal plate is arranged on the undersurface of the fixing projection 20, and stopper pieces 22*b* on the sides of the metal plate are arranged on side surfaces of the fixing projection 20. In these stopper pieces on the sides, stopper holes 22*c* are provided coaxially with the pin attachment hole 20*a*.

More specifically, each stopper hole 22*c* of the stopper member 22 is formed such that its diameter is greater than the inner diameter of the fixing pipe 21, and shorter than the outer diameter of the fixing pipe 21, or in other words, the diameter of the pin attachment hole 20*a* of the fixing projection 20, as shown in FIG. 4 and FIG. 5. As a result, the stopper member 22 is structured such that, when the pin component 17 is being inserted into the fixing pipe 21 inserted into the pin attachment hole 20*a* of the fixing projection 20, the ends of the fixing pipe 21 come in contact with the rims of the stopper holes 22*c*, whereby the fixing pipe 21 is not slipped out from the pin attachment hole 20*a*.

Also, this stopper member 22 is formed such that each stopper hole 22*c* has an oblong shape which is long in the piece connection direction, as shown in FIG. 4 and FIG. 5. That is, the stopper member 22 herein is structured such that, even if the stopper holes 22*c* are at positions shifted in the piece connection direction when the stopper member 22 is on the fixing projection 20, the rims of the stopper holes 22*c* correspond to and come in contact with the ends of the fixing pipe 21 inserted into the pin attachment hole 20*a* of the fixing projection 20.

The first piece 7 is thinly formed by a sintered metal acquired by metal powder such as stainless steel or titanium alloy being sintered. More specifically, this first piece 7 is molded through processes in which metal powder such as stainless steel or titanium alloy is mixed into a fluid resin by Metal Injection Molding (MIM), and the mixture is filled into a molding die and is subjected to a sintering process in this state so that the resin is evaporated and the metal powder is sintered.

Also, in the first piece 7, even though the pair of first arm sections 10 having the screw holes 10*a* into which the ornament screws 12 are screwed and the fixing projection 20 to which the pin component 17 is attached through the fixing pipe 21 are thickly formed so as to ensure the strength of the pair of first arm sections 10 and that of the fixing projection 20, portions other than these sections are formed to be extremely thin, as shown in FIG. 4 and FIG. 5.

Accordingly, in the second piece 8, two supporting pillars 23 are provided, as shown in FIG. 3A to FIG. 5. These two supporting pillars 23 are structured such that, when the second piece 8 is arranged on the undersurface of the projection main body 11 of the first piece 7 and the fixing projection 20 of the first piece 7 is arranged between the pair of connection projections 18 of the second piece 8, each supporting pillar 23 comes in contact with the undersurface of the projection main body 11 of the first piece 7 so as to support this thin projection main body 11.

On the other hand, each second band piece 6 has a substantially same structure as the first band piece 5, as shown in FIG. 2, FIG. 7A, FIG. 7B, and FIG. 7C. That is, each second band piece 6 includes a third piece 25 made of the same metal as that of the first piece 7 of the first band piece 5, and a fourth piece 26 made of the same synthetic resin as that of the second piece 8 of the first band piece 5. The third piece 25 is hollow and quadrilateral in cross-section, in which a pair of third arm sections 27 which forms a second connection recess section 25*a* is open downward. Except for this structural difference, the third piece 25 has the same structure as that of the first piece 7 of the first band piece 5.

Figure 7A:
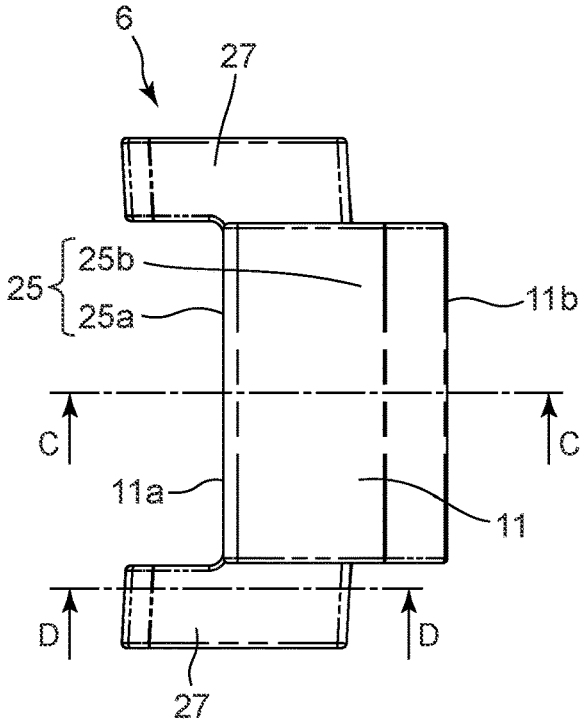
FIG. 7A is an enlarged front view of a second band piece of the wristwatch band shown in FIG. 2.
Figure 7B:
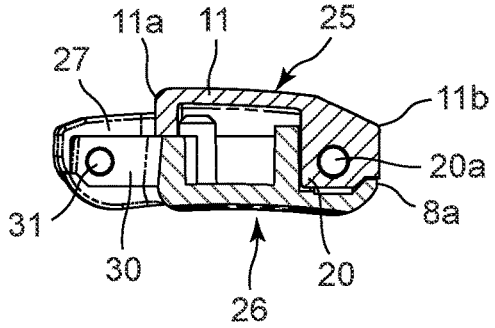
FIG. 7B is an enlarged cross-sectional view showing the second band piece taken along the C-C arrow view in FIG. 7A.
Figure 7C:
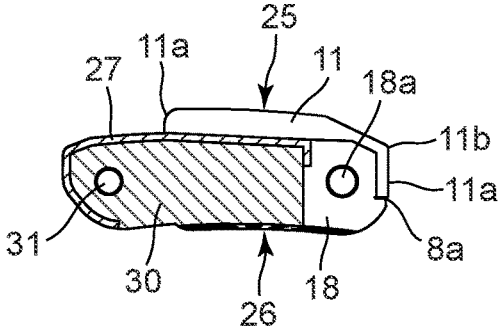
FIG. 7C is an enlarged cross-sectional view showing the second band piece taken along the D-D arrow view in FIG. 7A.

The fourth piece 26 is structured to include a pair of fourth arm sections 30 which is arranged on the undersurfaces of the pair of third arm sections 27 of the third piece 25, as shown in FIG. 7B. Except for this structural difference, the fourth piece 26 has a substantially same structure as that of the second piece 8 of the first band piece 5. However, the third piece 25 and the fourth piece 26 have no engaging and holding section which is equivalent to the engaging and holding section 14 of the first band piece 5 and by which the fourth piece 26 is engaged with and held on the third piece 25.

In the pair of third arm sections 27 of the third piece 25 and the pair of fourth arm sections 30 of the fourth piece 26, second pin insertion holes 31 into which the corresponding pin component 17 is inserted are coaxially provided to correspond to one another, as shown in FIG. 7B. The second band piece 6 is structured such that the third piece 25 and the fourth piece 26 are attached to each other by the ends of the pin component 17 being inserted into these second pin insertion holes 31 of the third arm sections 27 of the third piece 25 and the fourth arm sections 30 of the fourth piece 26.

Also, the second band piece 6 is structured such that, either the first connection projection section 7*b* of the adjacent first band piece 5 or a second connection projection section 25*b* of an adjacent second band piece 6 is arranged in the second connection recess section 25*a* of the second band piece 6, and the second band piece 6 is connected to the first band piece 5 or the adjacent second band piece 6 in this state by the corresponding pin component 17, as shown in FIG. 1, FIG. 2, FIG. 7A, FIG. 7B, and FIG. 7C.

More specifically, the second band piece 6 is structured such that, in the case where the second band piece 6 is connected to the first band piece 5, the corresponding pin component 17 is inserted into the second pin insertion hole 31 of the third arm section 27 and that of the fourth arm section 30 on one side, inserted into the first pin insertion holes 18*a* of the pair of connection projections 18 of the first band piece 5 and the fixing pipe 21 in the pin attachment hole 20*a* of the fixing projection 20, and inserted into the second pin insertion hole 31 of the third arm section 27 and that of the fourth arm section 30 on the other side with the first connection projection section 7*b* of the adjacent first band piece 5 being arranged in the second connection recess section 25*a*, as shown in FIG. 1, FIG. 2, FIG. 7A, FIG. 7B, and FIG. 7C.

That is, the second band piece 6 is structured such that the ends of the pin component 17 inserted into the first pin insertion holes 18*a* of the pair of connection projections 18 and the fixing pipe 21 in the pin attachment hole 20*a* of the fixing projection 20 in the first connection projection section 7*b* of the first band piece 5 are arranged in the pin insertion holes 31 of the pair of third arm sections 27 and those of the pair of fourth arm sections 30, whereby the second band piece 6 is the connected to the first band piece 5 by the pin component 17 with the third piece 25 and the fourth piece 26 of the second band piece 6 being arranged overlapping with each other, as shown in FIG. 1, FIG. 2, FIG. 7A, FIG. 7B, and FIG. 7C.

Also, the second band piece 6 is structured such that, in the case where the second band piece 6 is connected to the adjacent second band piece 6, the corresponding pin component 17 is inserted into a second pin insertion hole 31 of a third arm section 27 and that of a fourth arm section 30 on one side of the adjacent second band piece 6, inserted into first pin insertion holes 18*a* of a pair of connection projections 18 and a fixing pipe 21 of a pin attachment hole 20*a* of a fixing projection 20 in the second band piece 6, and inserted into a second pin insertion hole 31 of the third arm section 27 and that of the fourth arm section 30 on the other side of the adjacent second band piece 6 with the second connection projection section 25*b* of the second band piece 6 being arranged in a second connection recess section 25*a* of the adjacent second band piece 6, as shown in FIG. 1, FIG. 2, FIG. 7A, FIG. 7B, and FIG. 7C.

That is, the second band piece 6 is structured such that the ends of the pin component 17 inserted into the first pin insertion holes 18*a* of the pair of connection projections 18 and the fixing pipe 21 in the pin attachment hole 20*a* of the fixing projection 20 are arranged in the pin insertion holes 31 of the pairs of third and fourth arm sections 27 and 30 of the adjacent second band piece 6, whereby the second band piece 6 is connected to the adjacent second band piece 6 by the pin component 17 with the third piece 25 and the fourth piece 26 of the second band piece 6 being arranged overlapping with each other, as shown in FIG. 1, FIG. 2, FIG. 7A, FIG. 7B, and FIG. 7C.

Next, a procedure for assembling each watch band 2 of the wristwatch is described.

In the case of this embodiment, first, the first band piece 5 is assembled. Here, before this assembly, the first piece 7 is molded by a sintering process in which metal powder such as stainless steel or titanium alloy is sintered, and the second piece 8 is molded by injection molding of synthetic resin.

Then, the first piece 7 is arranged on top of and covers the second piece 8. Here, before this arrangement, the fixing pipe 21 is inserted into the pin attachment hole 20*a* provided in the fixing projection 20 of the first piece 7 and the stopper member 22 is arranged between the pair of connection projections 18 of the second piece 8. That is, the stopper holes 22*c* of the stopper pieces 22*b* on the sides of the stopper member 22 coaxially correspond to the first pin insertion holes 18*a* provided in the pair of connection projections 18 of the second piece 8.

In this state, the first piece 7 is arranged on top of the second piece 8. Here, the fixing projection 20 of the first piece 7 is arranged between the pair of connection projections 18 of the second piece 8. Then, the placement piece 22*a* in the middle of the stopper member 22 arranged between the pair of connection projections 18 of the second piece 8 is arranged on the undersurface of the fixing projection 20, and the stopper pieces 22*b* on the sides of the stopper member 22 are arranged on the side surfaces of the fixing projection 20.

Here, the stopper holes 22*c* of the stopper member 22 coaxially correspond to the pin attachment hole 20*a* of the fixing projection 20. Simultaneously, the pin attachment hole 20*a* provided in the fixing projection 20 of the first piece 7 coaxially corresponds to the first pin insertion holes 18*a* provided in the pair of connection projections 18 of the second piece 8.

When the stopper member 22 is to be arranged on the fixing projection 20 as described above, since the stopper holes 22*c* of the stopper pieces 22*b* have an oblong shape which is long in the piece connection direction, the rims of the stopper holes 22*c* are arranged corresponding to the ends of the fixing pipe 21 inserted into the pin attachment hole 20*a* of the fixing projection 20 even if the stopper holes 22*c* are at positions shifted in the piece connection direction.

Also, here, the projection main body 11 of the first piece 7 is supported by the two supporting pillars 23 provided in the second piece 8, and the contact holding section 8*a* of the second piece 8 is held and protected by the protection cover 11*c* of the first piece 7. As a result, the second piece 8 is provisionally fixed to the first piece 7. Here, in this fixation, the second piece 8 is engaged with and held in the first piece 7 by the engaging and holding section 14.

That is, when the first piece 7 is arranged on top of and covers the second piece 8 and the contact holding section 8*a* of the second piece 8 is held by the protection cover 11*c* of the first piece 7, the resilient engaging sections 15 of the engaging and holding section 14 provided on the side portions of the one end of the second piece 8 are caught by the catching holes 16 of the engaging and holding section 14 provided in the pair of first arm sections 10 of the first piece 7. Here, the resilient supporting sections 15*a* of the resilient engaging sections 15 of the second piece 8 come in contact with the inner surfaces of the cutout recess sections 13 of the pair of first arm sections 10 opposing the resilient supporting sections 15*a*, and are flexurally deformed in a direction away from the catching holes 16 of the first piece 7.

Then, when the engaging projections 15*b* of the flexurally deformed resilient supporting sections 15*a* reach positions corresponding to the catching holes 16 of the first piece 7, these engaging projections 15*b* are inserted into and caught in the catching holes 16 of the first piece 7 by the resilient recovery force of the flexurally deformed resilient supporting sections 15*a*. As a result, the second piece 8 made of synthetic resin is attached to the first piece 7 made of metal while being covered and protected by the first piece 7 except for its lower surface side, whereby the assembly of the first band piece 5 is completed.

Next, the second band piece 6 is assembled. In this case as well, before the assembly, the third piece 25 is molded by a sintering process in which metal powder such as stainless steel or titanium alloy is sintered and the fourth piece 26 is molded by injection molding of synthetic resin, as in the case of the first band piece 5. Then, the third piece 25 is arranged on top of and covers the fourth piece 26.

Here, before this arrangement, the fixing pipe 21 is inserted into and arranged in the pin attachment hole 20*a* provided in the fixing projection 20 of the third piece 25, and the stopper member 22 is arranged between the pair of connection projections 18 of the fourth piece 26, as in the case of the first band piece 5. In this state, when the third piece 25 is arranged on top of and covers the fourth piece 26, the fixing projection 20 of the third piece 25 is arranged between the pair of connection projections 18 of the fourth piece 26.

In addition, the pair of fourth arm sections 30 of the fourth piece 26 is arranged under the pair of third arm sections 27 of the third piece 25, whereby the second pin insertion holes 31 of the pair of third arm sections 27 and those the pair of fourth arm sections 30 coaxially correspond to one another. Here, the projection main body 11 of the third piece 25 is supported by two supporting pillars 23 provided in the fourth piece 26, and a contact holding section 8*a* of the fourth piece 26 is held and protected by a protection cover 11*c* of the third piece 25. As a result, the fourth piece 26 is provisionally fixed to the third piece 25.

The second band piece 6 assembled as described above is then connected to the first band piece 5. In this case, the first connection projection section 7*b* of the first piece 7 of the first band piece 5 and the second piece 8 of the first band piece 5 arranged under and corresponding to the first connection projection section 7*b* are arranged between the pair of third arm sections 27 of the second connection recess section 25*a* in the third piece 25 of the second band piece 6 and between the pair of fourth arm sections 30 of the second band piece 6 arranged under and corresponding to the pair of third arm sections 27.

As a result, the first pin insertion holes 18*a* of the pair of connection projections 18 in the first band piece 5 coaxially correspond to the second pin insertion holes 31 provided in the pair of third arm sections 27 and the pair of fourth arm sections 30 in the second band piece 6, and the pin attachment hole 20*a* of the fixing projection 20 in the first band piece 5 and the fixing pipe 21 arranged in the pin attachment hole 20*a* coaxially correspond to the first pin insertion holes 18*a* of the pair of connection projections 18 of the first band piece 5.

In this state, one pin component 17 is inserted into the second pin insertion holes 31 of the second band piece 6 on one side, the first pin insertion holes 18*a* of the first band piece 5, the fixing pipe 21 in the pin attachment hole 20*a*, and the second pin insertion holes 31 of the second band piece 6 on the other side. As a result, the first band piece 5 and the second band piece 6 are connected to each other by the one pin component 17. Here, the pair of connection projections 18 of the second piece 8 and the fixing projection 20 of the first piece 7 in the first band piece 5 are connected to one another. As a result, the first piece 7 and the second piece 8 are reliably and firmly attached to each other by the pin component 17.

Also, here, the ends of the pin component 17 are inserted into the second pin insertion holes 31 of the pair of third arm sections 27 of the third piece 25 and those of the pair of fourth arm sections 30 of the fourth piece 26 in the second band piece 6, whereby the pair of third arm sections 27 and the pair of fourth arm sections 30 are connected to each other while vertically overlapping with each other. As a result, the third piece 25 and the fourth piece 26 of the second band piece 6 are reliably and firmly attached to each other by the pin component 17.

Then, the adjacent second band piece 6 is connected to the above-described second band piece 6 connected to the first band piece 5. In this case, first, the second connection projection section 25*b* of the second band piece 6 connected to the first band piece 5 is arranged in the second connection recess section 25*a* of the adjacent second band piece 6. Here, the first pin insertion holes 18*a* provided in the pair of connection projections 18 of the fourth piece 26 in the second band piece 6 connected to the first band piece 5 coaxially correspond to the second pin insertion holes 31 of the pair of third arm sections 27 of the third piece 25 and those of the pair of fourth arm sections 30 of the fourth piece 26 in the adjacent second band piece 6.

Moreover, here, the pin attachment hole 20*a* provided in the fixing projection 20 of the third piece 25 of the second band piece 6 connected to the first band piece 5 and the fixing pipe 21 arranged in the pin attachment hole 20*a* coaxially correspond to the first pin insertion holes 18*a* in the pair of connection projections 18 of the fourth piece 26 of the second band pieces 6.

In this state, one pin component 17 is inserted into second pin insertion holes 31 on one side among all the second pin insertion holes 31 of the adjacent second band piece 6, inserted into the first pin insertion holes 18*a* and the fixing pipe 21 in the pin attachment hole 20*a* in the second band piece 6 connected to the first band piece 5, and inserted into second pin insertion holes 31 of the adjacent second band pieces 6 on the other side.

As a result, the adjacent second band pieces 6 and the second band piece 6 connected to the first band piece 5 are connected to each other by the pin component 17. Here, since the pair of connection projections 18 of the fourth piece 26 and the fixing projection 20 of the third piece 25 in the second band piece 6 connected to the first band piece 5 are connected to one another by the pin component 17, the third piece 25 and the fourth piece 26 are reliably and firmly attached to each other by the pin component 17 while vertically overlapping with each other.

Also, here, the pin component 17 is inserted into the second pin insertion holes 31 in the pair of third arm sections 27 of the third piece 25 and those in the pair of fourth arm sections 30 of the fourth piece 26 in the adjacent second band piece 6, whereby the pair of third arm sections 27 and the pair of fourth arm sections 30 are connected to each other. As a result, the third piece 25 of the adjacent second band piece 6 and the fourth piece 26 thereof are reliably and firmly attached to each other by the pin component 17 while vertically overlapping with each other.

By a plurality of second band pieces 6 being sequentially connected to one another for each watch band 2 as described above, the assembly of the watch bands 2 shown in FIG. 1 is completed. Then, each watch band 2 is attached to the wristwatch case 1. Here, before this attachment, each connection member 9 is attached to the corresponding band attachment section 3 of the wristwatch case 1. That is, the connection pipe 9*a* of this connection member 9 is inserted into the attachment hole 3*a* of the band attachment section 3, so that the two connection pieces 9*b* of the connection member 9 protrude from the sides of the band attachment section 3.

In this state, the band attachment section 3 is arranged in the first connection recess section 7*a* of the first band piece 5 of the corresponding watch band 2. Here, the two connection pieces 9*b* of the connection member 9 protruding from the sides of the band attachment section 3 are pressed into the attachment hole 3*a* of the band attachment section 3 against the spring force of the spring member 9*c*. In this state, the band attachment section 3 is arranged between the pair of first arm sections 10 corresponding to the first connection recess section 7*a* of the first band piece 5, whereby the screw holes 10*a* of the pair of first arm sections correspond to the two connection pieces 9*b* of the connection member 9.

Accordingly, the two connection pieces 9*b* of the connection member 9 are pushed outward from the ends of the connection pipe 9*a* by the spring force of the spring member 9*c*, and inserted into the screw holes 10*a* of the pair of first arm sections 10 of the first band piece 5. As a result, the first band piece 5 of the watch band 2 is attached to the band attachment section 3. That is, the watch band 2 is attached to the band attachment section 3 of the wristwatch case 1. Lastly, the ornament screws 12 are attached to the screw holes 10*a* of the pair of first arm sections 10, whereby the screw holes 10*a* of the pair of first arm sections 10 are covered.

In the case of the watch band 2 assembled as described above, even though the second piece 8 of the first band piece 5 and the fourth piece 26 of each second band piece 6 are made of synthetic resin, the watch band 2 gives the appearance that the entire band is made of metal when viewed from the front surface side because the first piece 7 of the first band piece 5 and the third piece 25 of the second band piece 6 are made of metal and the second piece 8 and the fourth piece 26 are covered by these first and third metal pieces 7 and 25 except for their lower surface sides. As a result, a sophisticated feeling is given.

Also, this watch band 2 is structured such that, even if the first band piece 5 and the second band piece 6 are subjected to an external impact, the second piece 8 and the fourth piece 26 made of synthetic resin are reliably and favorably protected by the first piece 7 and the third piece 25 made of metal so that the second piece 8 and the fourth piece 26 are not damaged by the impact.

Moreover, in the case of this watch band 2, the first piece 7 and the third piece 25 are made of a sintered metal acquired by metal powder such as stainless steel or titanium alloy being sintered. Accordingly, even though the first piece 7 and the third piece 25 have complicated shapes, they can be easily and thinly formed.

Also, in the case of the first band piece 5 and the second band piece 6 described above, the fixing projections 20 to which the pin components 17 are attached via the fixing pipes 21 are thickly formed to ensure the strength of these fixing projections 20. However, since the thicknesses of portions excluding these sections are formed to be extremely thin, the weight saving of the first band piece 5 and the second band piece 6 is achieved.

In the structures of the band pieces of the band disclosed in Japanese Utility Model Registration No. 3148398, each band piece is formed by the pair of outer pieces, the inner piece, and the side pieces being connected to one another by the pin component, and these band pieces are connected to one another by other pin components. Accordingly, there is a problem in that a large number of components are required and the assembly is complicated and troublesome.

In contrast, the first band piece 5 in each watch band 2 of the wristwatch of the present embodiment includes the first piece 7 which has the first connection recess section 7*a* recessed in the piece connection direction and the first connection projection section 7*b* projecting in the piece connection direction, the second piece 8 which is arranged on the undersurface of the first piece while corresponding to the first connection projection section 7*b* of the first piece 7, and the engaging and holding section 14 which engages the first piece 7 with the second piece 8 and holds them. As a result, the structure is simplified.

That is, in the first band piece 5 of this watch band 2, the second piece 8 is arranged on the undersurface of the first piece 7 while corresponding to the first connection projection section 7*b* of the first piece 7, whereby the first piece 7 is arranged overlapping with and covering the second piece 8. In addition, in this state, the first piece 7 and the second piece 8 are engaged with and held to each other by the engaging and holding section 14. As a result of this structure, the first piece 7 and the second piece 8 can be attached to each other with them overlapping with each other, which simplifies the structure and whereby the first band piece 5 can be easily assembled with less components and no additional component.

Also, in the case of the first band piece 5 of this watch band 2, the first piece 7 is made of metal and the second piece 8 is made of synthetic resin. As a result of this structure, the second piece 8 which is made of synthetic resin can be covered and protected by the first piece 7 which is made of metal. In addition, weight saving can be achieved by this second piece 8 made of synthetic resin.

As such, in the case of the first band piece 5 of this watch band 2, the second piece 8 is formed of synthetic resin, and the first piece 7 formed of metal is arranged on the front surface of the first band piece 5. As a result of this structure, even if the first band piece 5 is subjected to an external impact, the second piece 8 can be reliably and favorably protected by the first piece 7 so that the second piece 8 is not damaged or broken by the impact. In addition, a sophisticated feeling can be given by the first piece 7.

Also, in the first band piece 5 of this watch band 2, the engaging and holding section 14 includes the resilient engaging sections 15 which are provided to be resiliently deformable on the second piece 8 and correspond to the first connection recess section 7*a* of the first piece 7, and the catching holes 16 which are provided in the surfaces of the first piece 7 opposing the resilient engaging sections 15 and catch the resilient engaging sections 15. Accordingly, by resilient deformation, the resilient engaging sections 15 of the second piece 8 can be reliably and favorably caught by the catching holes 16 of the first piece 7, whereby the second piece 8 can be easily attached to the first piece 7.

Moreover, in the first band piece 5 of this watch band 2, the resilient engaging sections 15 include the resilient supporting sections 15*a* which are provided to be flexurally deformable on the second piece 8 and correspond to the first connection recess section 7*a* of the first piece 7, and the engaging projections 15*b* which are provided on the resilient supporting sections 15*a* and caught by the catching holes 16. Accordingly, when the resilient engaging sections 15 of the second piece 8 are to be caught by the catching holes 16 of the first piece 7, the resilient supporting sections 15*a* can be flexurally deformed in the direction away from the catching holes 16, whereby the engaging projections 15*b* can be easily and reliably caught by the catching holes 16 by the resilient recovery force of the flexurally deformed resilient supporting sections 15*a*.

Furthermore, in the first band piece 5 of this watch band 2, the resilient engaging sections 15 are provided to be resiliently deformable in the piece connection direction, and the catching holes 16 are provided such that their central axes are oriented in the piece connection direction. As a result of this structure, the resilient engaging sections 15 can be easily caught by the catching holes 16 only by the second piece 8 being inclined in the piece connection direction such that the first piece 7 and the second piece 8 overlap with each other, whereby efficiency in the assembly of the first band piece 5 can be enhanced.

More specifically, in the first band piece 5 of this watch band 2, when the second piece 8 is inclined in the piece connection direction such that the first piece 7 and the second piece 8 overlap with each other, the engaging projections 15*b* are pressed against the surfaces of the cutout recess section 13 of the first arm sections 10 opposing these engaging projections 15*b*, whereby the resilient supporting sections 15*a* are flexurally deformed. By the resilient recovery force of these deformed resilient supporting sections 15*a*, the engaging projections 15*b* can be reliably and favorably caught by the catching holes 16.

Also, in the first band piece 5 of this watch band 2, the first connection projection section 7*b* of the first piece 7 includes the protection cover 11*c* which protects the above-described other end of the second piece 8 in the piece connection direction. Accordingly, this other end of the second piece 8 made of synthetic resin can be favorably protected by the protection cover 11*c* of the first piece 7 made of metal, and the second piece 8 can be provisionally fixed to the first piece 7 by the contact holding section 8*a* on this end of the second piece 8 being held by the protection cover 11*c* of the first piece 7.

Moreover, in the first band piece 5 of this watch band 2, the resilient engaging sections 15 can be easily caught by the catching holes 16 only by the contact holding section 8*a* on this end of the second piece 8 being held by the protection cover 11*c* of the first piece 7 and the second piece 8 being inclined in the piece connection direction such that the first piece 7 and the second piece 8 overlap with each other. As a result of this structure, the first piece 7 and the second piece 8 can be favorably attached to each other.

Furthermore, in the case of the first band piece 5 of this watch band 2, the first piece 7 is formed using a sintered metal acquired by metal powder being sintered. Therefore, the first piece 7 can be thinly and easily manufactured in spite of its complicated shape. More specifically, this first piece 7 is molded by metal powder such as stainless steel or titanium alloy being mixed into a fluid resin by Metal Injection Molding (MIM) and the mixture being filled into a molding die and subjected to a sintering process in this state so that the resin is evaporated and the metal powder is sintered. Thus, the first piece 7 can be thinly and easily manufactured in spite of its complicated shape.

Still further, the first band piece 5 of this watch band 2 includes the pin component 17 which is attached to the first piece 7 and the second piece 8 in the direction perpendicular to the piece connection direction and couples the first piece 7 to the second piece 8 with the first piece 7 and the second piece 8 overlapping with each other. As a result of this structure, the first piece 7 and the second piece 8 can be reliably and firmly attached to each other with the first piece 7 and the second piece 8 overlapping with each other.

More specifically, in the first band piece 5 of this watch band 2, the first piece 7 includes the fixing projection 20. In this fixing projection 20, the pin attachment hole 20*a* into which the pin component 17 is inserted is provided in the direction perpendicular to the piece connection direction. In addition, the second piece 8 includes the pair of connection projections 18. In these connection projections 18, the first pin insertion holes 18*a* are provided which coaxially correspond to the pin attachment hole 20*a* of the fixing projection 20 arranged between these connection projections 18. As a result of this structure, the first piece 7 and the second piece 8 can be easily coupled to each other only by the pin component 17 being inserted into the first pin insertion holes 18*a* of the pair of the connection projections 18 and the pin attachment hole 20*a* of the fixing projection 20.

Also, in the case of the first band piece 5 of this watch band 2, when the pin component 17 is to be inserted into the first pin insertion holes 18*a* of the pair of connection projections 18 and the pin attachment hole 20*a* of the fixing projection 20, the first connection projection section 7*b* of the first piece 7 is arranged in the second connection recess section 25*a* of the third piece 25 of the second band piece 6, and the ends of the pin component 17 are arranged in the second pin insertion holes 31 of the pair of third arm sections 27 and those of the pair of fourth arm sections 30 in the second band piece 6, whereby the second band piece 6 is coupled to the first piece 7.

More specifically, in the case of the first band piece 5 of this watch band 2, when the first piece 7 and the second piece 8 are to be attached to each other in an overlapping state by the pin component 17 being inserted into the first pin insertion holes 18*a* of the pair of connection projections 18 and the pin attachment hole 20*a* of the fixing projection 20, the ends of the pin component 17 are arranged in the second pin insertion holes 31 of the pair of third arm sections 27 and those of the pair of fourth arm sections 30 in the second band piece 6, whereby the first piece 7 and the second piece 8 are coupled to each other and the second band piece 6 is connected to the first band piece 5. Then, other second band pieces 6 are sequentially connected to the second band piece 6 connected to the first band piece 5. By this procedure, the watch band 2 can be easily assembled.

Also, in the case of the first band piece 5 of this watch band 2, the band attachment section 3 is arranged in the first connection recess section 7*a* of the first piece 7, and the first band piece 5 is attached to the band attachment section 3 by the connection member 9. As a result of this structure, the first band piece 5 can be easily attached to the band attachment section 3 of the wristwatch case 1 with the first piece 7 and the second piece 8 being attached to each other in an overlapping state.

That is, the first band piece 5 of this watch band 2 can be easily attached to the band attachment section 3 only by the connection pipe 9*a* of the connection member 9 being attached to the attachment hole 3*a* in the band attachment section 3 of the wristwatch case 1 such that the pair of connection pieces 9*b* protruding from the ends of the connection pipe 9*a* protrudes from the sides of the band attachment section 3, and the band attachment section 3 being arranged in the first connection recess section 7*a* with these connection pieces 9*b* being pressed into the band attachment section 3 against the spring force of the spring member 9*c*.

More specifically, in the case of the first band piece 5 of this watch band 2, when the pair of connection pieces 9*b* of the connection member 9 is positioned opposing the screw holes 10*a* of the pair of first arm sections 10 corresponding to the first connection recess section 7*a* of the first band piece 5 by the band attachment section 3 being arranged in the first connection recess section 7*a* of the first band piece 5, these connection pieces 9*b* are pushed outward by the spring force of the spring member 9*c* and inserted into the screw holes 10*a* of the pair of first arm sections 10, whereby the first band piece 5 can be easily and reliably attached to the band attachment section 3.

In the above-described embodiment, the resilient engaging sections 15 of the engaging and holding section 14 are provided on the side portions of the one end of the second piece 8 which correspond to the first connection recess section 7*a* of the first band piece 5, and the catching holes 16 of the engaging and holding section 14 are provided in the cutout recess sections 13 of the pair of first arm sections 10 of the first piece 7 to which the resilient engaging sections 15 correspond in the piece connection direction. However, the present invention is not limited thereto, and a structure may be adopted in which the engaging and holding section 14 is provided in the direction perpendicular to the piece connection direction.

More specifically, the engaging and holding section 14 may be structured such that the resilient engaging sections 15 are provided on the side portions of the one end of the second piece 8 in a manner to be flexurally deformable in the direction perpendicular to the piece connection direction, and the catching holes 16 are provided in the opposing surfaces of the cutout recess sections 13 of the pair of first arm sections 10 of the first piece 7 in the flexural deformation direction of the resilient engaging sections 15 such that the central axes of the catching holes 16 are oriented in the direction perpendicular to the piece connection direction.

Also, in the present invention, a structure may be adopted in which the resilient engaging sections 15 are provided on the first piece 7 and the catching holes 16 are provided in the second piece 8. In addition, a structure may be adopted in which projections are provided on the first piece 7 and catching holes which correspond to the projections and are resiliently deformable are provided in the second piece 8.

Also, in the above-described embodiment, the first piece 7 is formed of metal and the second piece 8 is formed of synthetic resin. However, the present invention is not limited thereto, and a structure in which the first piece 7 is formed of synthetic resin and the second piece 8 is formed of metal, a structure in which the first piece 7 and the second piece 8 are both formed of synthetic resin, or a structure in which the first piece 7 and the second piece 8 are both formed of metal may be adopted.

Moreover, in the above-described embodiment, the screw holes 10*a* into which the ornament screws 12 are screwed are coaxially provided in the pair of first arm sections 10 of the first piece 7. However, in the present invention, these holes are not necessarily required to be screw holes, and may be insertion holes into which the connection member 9 or another pin component 17 is inserted.

Furthermore, in the above-described embodiment, the present invention has been applied in a wristwatch. However, the present invention is not necessarily required to be applied in a wristwatch. For example, the present invention is applicable to a bracelet, a bag, or the like.

While the present invention has been described with reference to the preferred embodiments, it is intended that the invention be not limited by any of the details of the description therein but includes all the embodiments which fall within the scope of the appended claims.

What is claimed is:

1. A band piece comprising:

a first piece which has a connection recess recessed in a piece connection direction and a connection projection projecting in the piece connection direction;

a second piece which is arranged on one surface of the first piece while corresponding to the connection projection of the first piece; and an engaging portion which engages the first piece with the second piece, wherein the engaging portion includes a resilient engaging portion which is provided to be resiliently deformable on the second piece and corresponds to the connection recess of the first piece, and a catching hole which is provided in a surface of the first piece opposing the resilient engaging portion and catches the resilient engaging portion.

2. The band piece according to claim 1, wherein the first piece is formed of metal, and wherein the second piece is formed of synthetic resin.

3. The band piece according to claim 2, wherein the resilient engaging portion includes a resilient supporting portion which is provided to be flexurally deformable on the second piece and corresponds to the connection recess of the first piece, and an engaging projection which is provided on the resilient supporting portion and caught by the catching hole.

4. The band piece according to claim 3, wherein the resilient engaging portion is resiliently deformed in the piece connection direction, and wherein the catching hole is provided such that a central axis thereof is oriented in the piece connection direction.

5. The band piece according to claim 3, wherein the connection projection of the first piece includes a protection portion which protects an end of the second piece in the piece connection direction, and wherein the second piece is provisionally fixed to the first piece by the protection portion.

6. The band piece according to claim 2, wherein the resilient engaging portion is resiliently deformed in the piece connection direction, and wherein the catching hole is provided such that a central axis thereof is oriented in the piece connection direction.

7. The band piece according to claim 6, wherein the connection projection of the first piece includes a protection portion which protects an end of the second piece in the piece connection direction, and wherein the second piece is provisionally fixed to the first piece by the protection portion.

8. The band piece according to claim 2, wherein the connection projection of the first piece includes a protection portion which protects an end of the second piece in the piece connection direction, and wherein the second piece is provisionally fixed to the first piece by the protection portion.

9. The band piece according to claim 1, wherein the resilient engaging portion includes a resilient supporting portion which is provided to be flexurally deformable on the second piece and corresponds to the connection recess of the first piece, and an engaging projection which is provided on the resilient supporting portion and caught by the catching hole.

10. The band piece according to claim 9, wherein the resilient engaging portion is resiliently deformed in the piece connection direction, and wherein the catching hole is provided such that a central axis thereof is oriented in the piece connection direction.

11. The band piece according to claim 10, wherein the connection projection of the first piece includes a protection portion which protects an end of the second piece in the piece connection direction, and wherein the second piece is provisionally fixed to the first piece by the protection portion.

12. The band piece according to claim 9, wherein the connection projection of the first piece includes a protection portion which protects an end of the second piece in the piece connection direction, and wherein the second piece is provisionally fixed to the first piece by the protection portion.

13. The band piece according to claim 1, wherein the resilient engaging portion is resiliently deformed in the piece connection direction, and wherein the catching hole is provided such that a central axis thereof is oriented in the piece connection direction.

14. The band piece according to claim 13, wherein the connection projection of the first piece includes a protection portion which protects an end of the second piece in the piece connection direction, and wherein the second piece is provisionally fixed to the first piece by the protection portion.

15. The band piece according to claim 1, wherein the connection projection of the first piece includes a protection portion which protects an end of the second piece in the piece connection direction, and wherein the second piece is provisionally fixed to the first piece by the protection portion.

16. The band piece according to claim 1, wherein the first piece is formed of a sintered metal acquired by metal powder being sintered.

17. The band piece according to claim 1, further comprising:

a pin component which is attached to the first piece and the second piece in a direction perpendicular to the piece connection direction and couples the first piece to the second piece with the first piece and the second piece overlapping with each other.

18. The band piece according to claim 1, wherein the connection recess of the first piece is attached to a band attachment portion by a connection member after the band attachment portion is arranged in the connection recess.

19. A band comprising the band piece according to claim 1.

20. A timepiece comprising the band piece according to claim 1.

* * * * *